US006679716B2

(12) United States Patent
Nakagawa et al.

(10) Patent No.: US 6,679,716 B2
(45) Date of Patent: Jan. 20, 2004

(54) CONNECTOR

(75) Inventors: Hiroshi Nakagawa, Nagano (JP); Naoyuki Shinonaga, Nagano (JP); Daisuke Ito, Nagano (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 10/324,006

(22) Filed: Dec. 20, 2002

(65) Prior Publication Data

US 2003/0190828 A1 Oct. 9, 2003

(30) Foreign Application Priority Data

Apr. 9, 2002 (JP) ..... 2002-106553

(51) Int. Cl.[7] ..... H01R 11/22

(52) U.S. Cl. ..... 439/267; 439/79; 439/260; 439/497; 439/736

(58) Field of Search ..... 439/260, 267, 439/631, 635, 637, 736, 936, 79, 579, 497, 108, 610

(56) References Cited

U.S. PATENT DOCUMENTS 5,092,774 A * 3/1992 Milan
5,433,628 A * 7/1995 Sadaishi et al.
6,216,740 B1 * 4/2001 Hayashi et al.
6,524,119 B2 * 2/2003 Kato et al.

FOREIGN PATENT DOCUMENTS

JP P2000-68011 A 3/2000

* cited by examiner

*Primary Examiner*—Dean A. Reichard
*Assistant Examiner*—Nguyen T. Ha
(74) *Attorney, Agent, or Firm*—McDermott, Will & Emery

(57) ABSTRACT

A connector enabling wiping operation without changing the distance between a male connector and a female connector and capable of changing connectional association by mechanically operating the connector is obtained. The connector includes a male connector having a male connector terminal, a female connector having a female connector terminal, a relay connector terminal movably mounted on either a male connector body or a female connector body and a drive mechanism part bringing the relay connector terminal into contact with both of the male connector terminal and the female connector terminal and performing rubbing.

12 Claims, 5 Drawing Sheets

CONNECTOR

BACKGROUND OF THE INVENTION

1. Field of the Invention

The present invention relates to a connector capable of connecting, disconnecting or switching an electric signal.

2. Description of the Background Art

Recent semiconductor devices are rapidly integrated, to result in increasing importance of an inspection step for semiconductor devices. Referring to FIG. 7 showing a conventional inspection step, several stages of boards are arranged between a semiconductor device 127 to be inspected and a test head 121 provided with terminals of a tester. First, a motherboard 122 is arranged immediately above the test head 121. This motherboard 122 is provided with contacts arranged in response to the arrangement of the terminals on the test head 121, and remains unchanged regardless of the type of the semiconductor device 127 to be inspected. A female contact terminal (not shown) is provided on an upper portion of the motherboard 122, to be connected with a male contact terminal (not shown) provided on a lower portion of a performance board 124 located above the same by a cable 123.

The performance board 124 is formed by a plurality of boards. Connectors 110 are arranged between the boards forming the performance board 124. A contactor (test board) 125 is arranged on the performance board 124. Terminals 126 of the semiconductor device 127 to be inspected are directly connected to the test board 125. In general, a large number of semiconductor chips 127 are inspected at the same time. Assuming that each semiconductor chip 127 is formed with tens of terminals, therefore, the connectors 110 arranged between the boards forming the performance board 124 are provided with thousands of terminals, in order to simultaneously inspect hundreds of semiconductor chips 127.

The performance board 124 or a socket board is provided between the motherboard 122 and the semiconductor device 127 to be inspected, in order to attain connection with flexibility in response to the type of the semiconductor device 127 to be inspected and the performance to be inspected.

The present invention is directed to the connectors 110 employed for connecting the boards forming the aforementioned performance board 124 with each other, for example. The connectors 110 are provided with thousands of terminals as hereinabove described, and hence particular notice must be taken in order to reliably connect the terminals.

FIGS. 8 and 9 show the structure of each of the conventional connectors 110 employed for connecting the aforementioned boards forming the performance board 124 with each other. FIG. 9 is a sectional view taken along the line IX—IX in FIG. 8. The structure of the connector 110 is now described with reference to connection. First, a male connector 110*a* and a female connector 110*b* are mated with each other so that each male connector terminal 102 fixed to a male connector body 101 is located between each pair of female connector terminals 105 fixed to a female connector body. Then, connector terminal switching mechanism parts 107 press the female connector terminals 105 against the male connector terminal 102 for bringing the male and female connectors 110*a* and 110*b* into contact with each other, thereby attaining electrical contact.

Then, a push-up mechanism part 106 moves up to push up the male connector body 101. Thus, the male connector terminal 102 moves upward in the state frictionally in contact with the female connector terminals 105. The male and female connector terminals 102 and 105 must essentially be frictionally connected with each other in order to stably maintain electrical connection in an excellent state in a connector having a large number of pins, to which the present invention is directed. Such frictional connection between the connector terminals 102 and 105 is referred to as wiping operation or simply as wiping. A mechanism for this wiping operation is provided around the aforementioned connection part. Thus, a signal line connected to the male connector 110*a* can be electrically connected with a signal line connected to the female connector 110*b*.

In the aforementioned connector 110, the length of the connection part formed by the male and female connectors 110*a* and 110*b* is varied in wiping due to reciprocation of the male connector 110*a*. Therefore, the wiping mechanism provided around the aforementioned connection part must be so formed that the male connector 110*a* is reciprocative to vary the distance between the same and the female connector 110*b*. Consequently, the wiping mechanism provided around the connection part and other mechanism parts are complicated. Considering fluctuation of the width of the connector 110, a driving source such as a motor necessary for the wiping operation and a gear mechanism for transmitting the driving force must be arranged in an extremely complicated structure. In other words, the gear mechanism is complicated and the number of components for transmitting the driving force is increased. If the aforementioned reciprocation is unallowable, further, the type of the employed connector 110 must be limited.

In the aforementioned conventional connector 110, the signal lines connected to the male and female connector terminals 102 and 105 respectively are fixed in connectional association. In other words, the male and female connector terminals 102 and 105 must be connected or disconnected with or from each other while keeping fixed connectional association. Therefore, the aforementioned connectional association cannot be changed by mechanically operating the connector 110, for example.

SUMMARY OF THE INVENTION

A first object of the present invention is to provide a connector enabling wiping operation without changing the distance between a male connector and a female connector.

A second object of the present invention is to provide a connector capable of changing connectional association between a male connector terminal and a female connector terminal by mechanically operating the connector.

A connector according to a first aspect of the present invention comprises a male connector having a male connector body and a male connector terminal held by the male connector body, a female connector having a female connector terminal electrically connected with the male connector terminal and a female connector body holding the female connector terminal, a relay connector terminal movably mounted on either the male connector body or the female connector body, and a drive mechanism part bringing the relay connector terminal into contact with both of the male connector terminal and the female connector terminal and performing rubbing.

According to this structure, the distance between the male and female connectors may not be changed in wiping operation. Therefore, mechanism parts around the connector can be simplified. Further, height restriction against the used connector can be loosened. Each of the aforementioned drive mechanism part (wiping mechanism part) and a switching mechanism part described later is formed by a motor arranged around the connector and gears transmitting the driving force thereof. If the distance between the male and female connectors is varied, therefore, the arrangement of the aforementioned mechanisms is extremely complicated. Such complication of the mechanism parts around the connector can be relaxed due to the aforementioned structure. Consequently, components themselves can be simplified and the number of the components can be reduced. Further, the aforementioned mechanism parts can be improved in reliability and durability.

A connector according to a second aspect of the present invention comprises a male connector having a male connector body and at least two male connector terminals held by the male connector body and arranged along a prescribed direction and a female connector having at least two female connector terminals arranged along the same direction as the male connector terminals and a female connector body holding at least two female connector terminals. The connector also comprises a switching mechanism part inhibiting the male connector terminals and the female connector terminals from coming into electrical contact with each other in a first state and individually bringing the female connector terminals and the male connector terminals into electrical contact with each other when shifting from the first state to a second state. The connector further comprises a connection switching mechanism part rubbing either the male connector or the female connector with respect to the counterpart along the direction of arrangement of the connector terminals when the switching mechanism part is in the first state.

According to this structure, the male or female connector terminals can be displaced along the direction of arrangement thereof with no hindrance. Thus, the connector, i.e., a hard component, can switch the connectional relation. The connection switching mechanism part is formed by a mechanism similar to the aforementioned rubbing mechanism part.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

Figure 1:
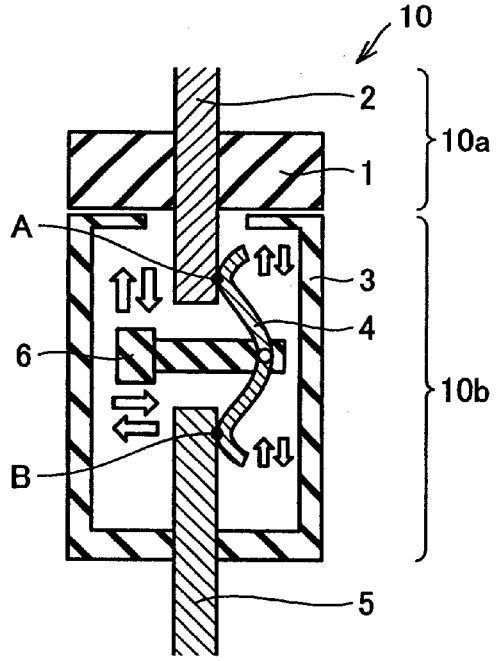
FIG. 1 is a sectional view showing a connector according to a first embodiment of the present invention.

Referring to FIG. 1 showing a connector 10 according to a first embodiment of the present invention, a male connector terminal 2 is fixed to a male connector body 1, and a female connector terminal 5 is fixed to a female connector body 3. A relay connector terminal 4 is arranged to connect the male connector terminal 2 and the female connector terminal 5 with each other. A drive mechanism part 6 drives the relay connector terminal 4.

In connection, a male connector 10*a* and a female connector 10*b* are aligned with each other for facing the male and female connector bodies 1 and 3 with each other. In this case, the male and female connector terminals 2 and 5 are separated from each other. At this time, the drive mechanism part 6 sets the relay connector terminal 4 on a position, rightward beyond that shown in FIG. 1, in contact with neither one of the male and female connector terminals 2 and 5. The drive mechanism part 6 is in a first state (on a first position) at this time.

In order to attain electrical connection between the male and female connector terminals 2 and 5, the drive mechanism part 6 is located on the left side (in a second state) as shown in FIG. 1, for bringing the relay connector terminal 4 into contact with both of the male and female connector terminals 2 and 5. The drive mechanism part 6 further vertically rubs while keeping this contact, for performing wiping.

The distance between the male and female connectors 10*a* and 10*b* remains unchanged from the alignment of the male and female connector bodies 1 and 3 up to completion of wiping. As compared with a case of arranging a wiping mechanism part on the assumption that the distance between the male and female connectors 10*a* and 10*b* changes, therefore, complicated arrangement can be prevented the number of components can be reduced.

Second Embodiment

Figure 2:
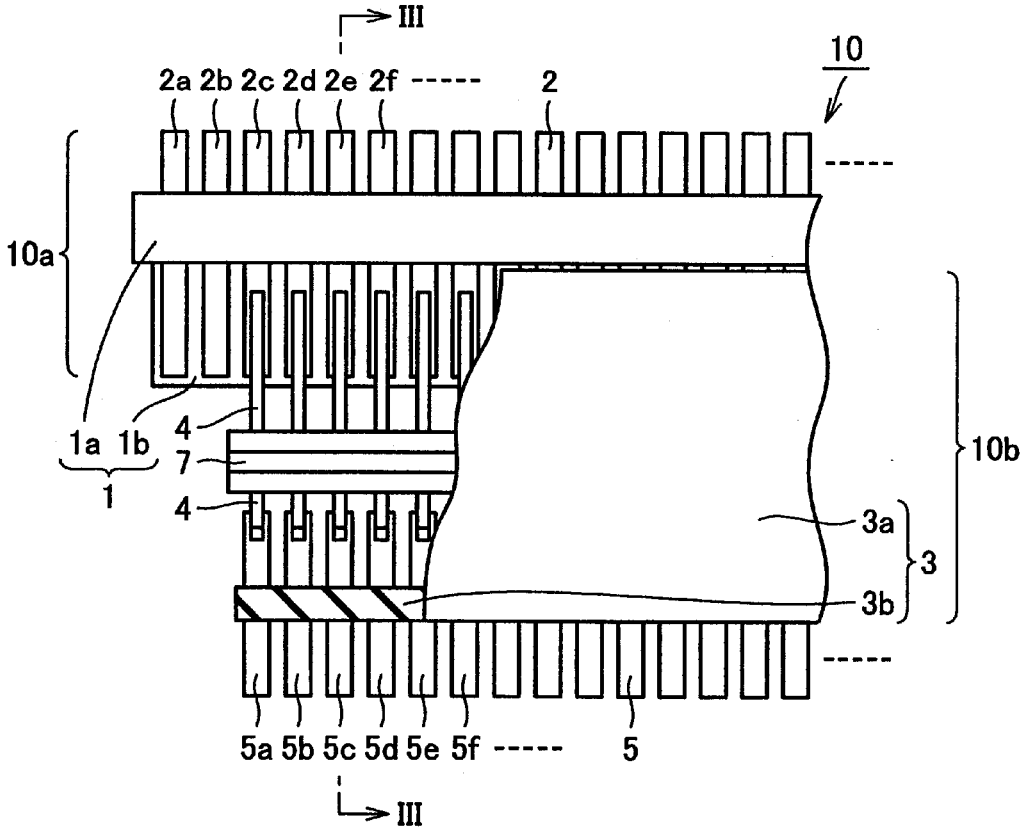
FIG. 2 is a partially fragmented front elevational view showing a connector according to a second embodiment of the present invention in a state where male connector terminals and relay connector terminals are not in contact with each other.
Figure 3:
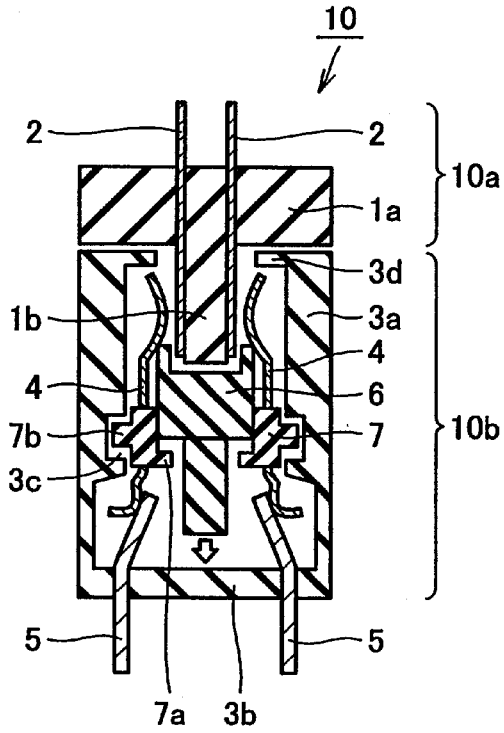
FIG. 3 is a sectional view taken along the line III—III in FIG. 2.

FIG. 2 is a partially fragmented front elevational view of a connector 10 according to a second embodiment of the present invention, and FIG. 3 is a sectional view taken along the line III—III in FIG. 2. Referring to FIGS. 2 and 3, a male connector 10*a* and a female connector 10*b* are mated and connected with each other. The male connector 10*a* has male connector terminals 2 and a male connector body 1 holding the male connector terminals 2. Pairs of male connector terminals 2 pass through a male connector body base part la to be arranged on both sides of a male connector body projection 1*b* projecting toward the female connector 10*b*. The male connector terminals 2 are prepared from copper plated with gold or the like, and the male connector body 1 is prepared from insulating resin. The male connector 10*a* can be integrally injection-molded by filling up a mold receiving the male connector terminals 2 therein with the insulating resin, for example.

The female connector 10*b* includes pairs of relay connector terminals 4 arranged on positions coming into contact with the male connector terminals 2, a drive mechanism part 6, pairs of female connector terminals 5, female connector bodies 3*a* and 3*b* and engaging parts 7. The drive mechanism part 6 is located between the pairs of relay connector terminals 4. The drive mechanism part 6 can vertically reciprocate to increase the distance between the pairs of relay connector terminals 4 against the elastic force thereof on a first position located on the upper end. When the drive mechanism part 6 shifts to a second position located on the lower end, (M1) the pairs of relay connector terminals 4 are restored to come into contact with the male connector terminals 2 and M2) the drive mechanism part 6 engages with drive mechanism engaging parts 7*a* of the engaging parts 7 mounted on the pairs of relay connector terminals 4 for moving the pairs of relay connector terminals 4 downward. The female connector terminals 5 are fixed to a bottom portion 3*b* of the female connector body 3. The female connector body 3 has side portions 3*a*, the bottom portion 3*b* and groove portions 3*c* provided inside the side portions 3*a* for guiding groove engaging portions 7*b* of the engaging parts 7 therethrough. The engaging parts 7 also have a function of holding the pairs of relay connector terminals 4. The female connector body 3 and the female connector terminals 5 are integrally injection-molded.

Figure 4:
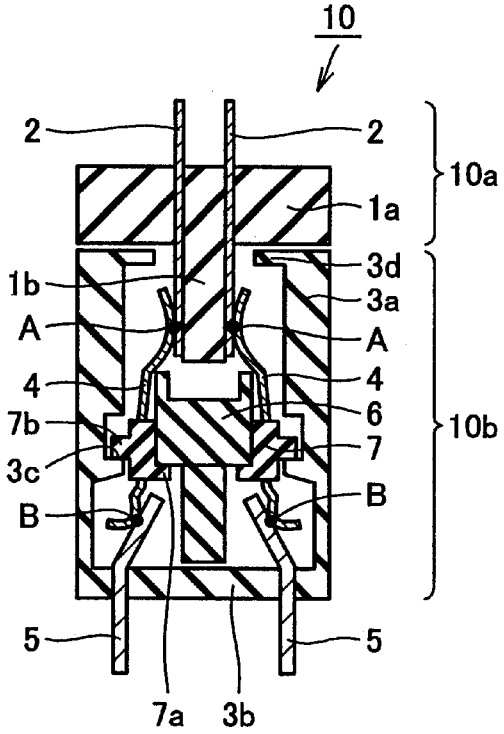
FIG. 4 is a sectional view showing a state where a drive mechanism part is located on a lower end (second position) for electrically connecting the male connector terminals with female connector terminals.

The operation of the connector 10 is now described. First, the drive mechanism part 6 is set on the upper end position, for inserting the male connector terminals 2 between the pairs of relay connector terminals 4. At this time, the male connector body base part 1*a* and an upper end 3*d* of the female connector body 3 are brought into contact with each other. Thereafter the drive mechanism part 6 is moved to the second position, i.e., the lower end position. Following the aforementioned movement of the drive mechanism part 6, the relay connector terminals 4 are restored by elasticity to come into contact with the male connector terminals 2. The drive mechanism part 6 further shifts downward to engage with the driving engaging parts 7*a* of the engaging parts 7 for moving the relay connector terminals 4 downward, and reaches the second position, i.e., the lower end, as shown in FIG. 4. At this time, the relay connector terminals 4 rub in a state pressed against the male connector terminals 2 on positions A, whereby wiping is so performed that the relay connector terminals 4 and the male connector terminals 2 can be stably electrically connected with each other.

When moving downward, the relay connector terminals 4 are also pressed against the female connector terminals 5 on portions B, for performing wiping. Therefore, the relay connector terminals 4 and the female connector terminals 5 can be stably electrically connected with each other.

In the aforementioned connector 10, the drive mechanism part 6 can move the relay connector terminals 4 without moving the male connector body 1 and the female connector body 3 for performing wiping with respect to the male connector terminals 2 and the female connector terminals 5. Therefore, the distance between the male connector 10*a* and the female connector 10*b* remains unchanged. Thus, a peripheral part of the connector 10 may not be dimensionally limited, and no complicated mechanism is required. Consequently, the working range and the application of the connector 10 can be widened as compared with the conventional connector.

In the connector according to the second embodiment of the present invention, the male connector and the female connector have at least two connector terminals arranged along a common direction at a common pitch. The connector can further comprise a rubbing mechanism for rubbing either the male connector or the female connector with respect to the counterpart along the direction of arrangement of the connector terminals when the drive mechanism part is in a first state.

According to this structure, the connectional relation between the male and female connector terminals can be switched at once. In this case, the distance between the male and female connector bodies remains unchanged in the longitudinal direction of the connector terminals, whereby complication of mechanisms around the connector can be relaxed. The aforementioned rubbing mechanism is formed by a power transmission mechanism or the like rubbing the male or female connector terminal in the aforementioned direction.

Third Embodiment

A connector 10 identical to that of the second embodiment shown in FIG. 2 is employed in a third embodiment of the present invention. The feature of this embodiment resides in that a drive mechanism part 6 is set on an upper end defining a first position for moving a male connector 10*a* or a female connector 10*b* along a direction of terminal arrangement while not bringing male connector terminals 2 into contact with relay connector terminals 4. The male connector terminals 2 vary female connector terminals 5 connected therewith due to rubbing along the direction of terminal arrangement.

In the aforementioned connector, the male connector terminals and the female connector terminals are arranged at a common constant pitch. The connection switching mechanism part can include a moving pitch control part rubbing either the male connector or the female connector with respect to the counterpart along the direction of arrangement of the connector terminals by integral times the prescribed pitch and stops the male connector or the female connector when the switching mechanism part is in the first state while bringing the male connector terminals and the female connector terminals into contact with each other on positions after the rubbing when the switching mechanism part shifts to the second state.

According to this structure, connection switching can be simply controlled. The connection switching can be controlled according to a general program or the like.

The aforementioned connector further includes a relay connector terminal movably mounted on either the male connector body or the female connector body. The switching mechanism part defines a clearance between the connector terminals held by the connector body not provided with the relay connector terminal and the relay connector terminal in the first state. The switching mechanism part can further bring the relay connector terminal into contact with both of the male connector terminals and the female connector terminals and perform rubbing when shifting from the first state to the second state.

According to this structure, wiping can be performed on the terminals without changing the distance between the male and female connectors also after rubbing (switching).

In the aforementioned connector, the switching mechanism part can be mounted on the connector body provided with the relay connector terminal for inhibiting the male connector terminals and the relay connector terminal from coming into contact with each other against elastic force of at least either the male connector terminals or the relay connector terminal, and elastically restoring at least either the male connector terminals or the relay connector terminal for pressing the male connector terminals and the relay connector terminal against each other while moving the relay connector terminal for elastically pressing the relay connector terminal against with the female connector terminals and rubbing the relay connector terminal with both of the male connector terminals and the female connector terminals when shifting from the first state to the second state.

According to this structure, wiping can be performed without changing the distance between the male and female connector bodies before and after connection switching by preparing the connector terminals from an elastic material such as a metal, for example, also in the connector according to the second aspect of the present invention. In this case, the switching mechanism part is functionally equivalent to the aforementioned drive mechanism part.

Figure 5:
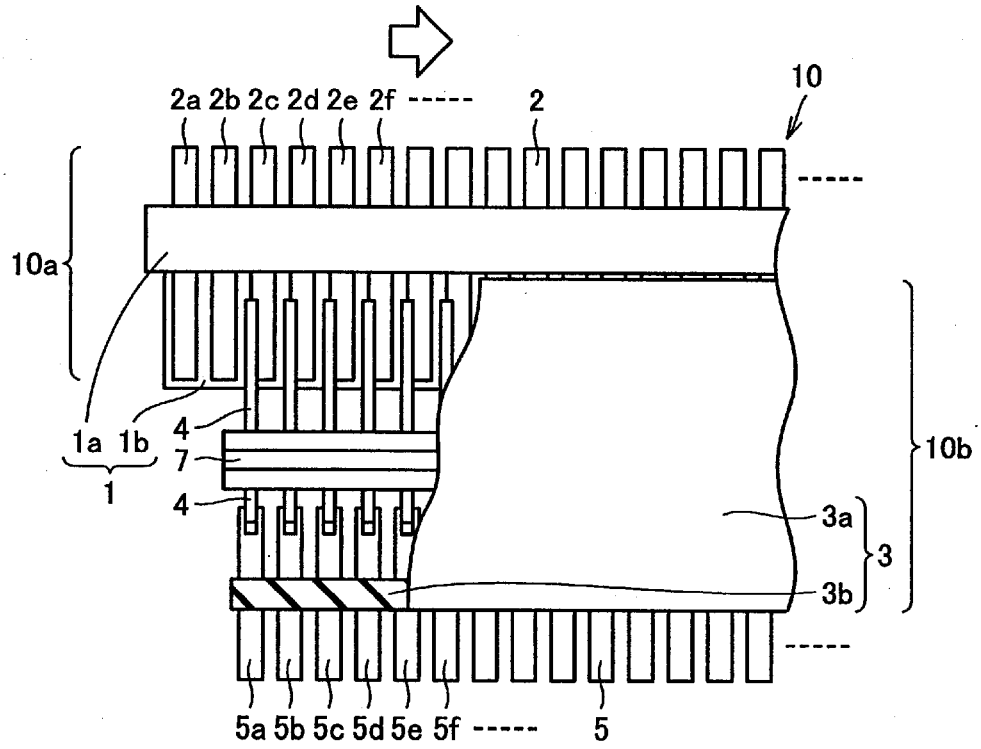
FIG. 5 is a partially fragmented front elevational view of a connector according to a third embodiment of the present invention in a state where a male connector rubs rightward so that male connector terminals and relay connector terminals are not in contact with each other.
Figure 6:
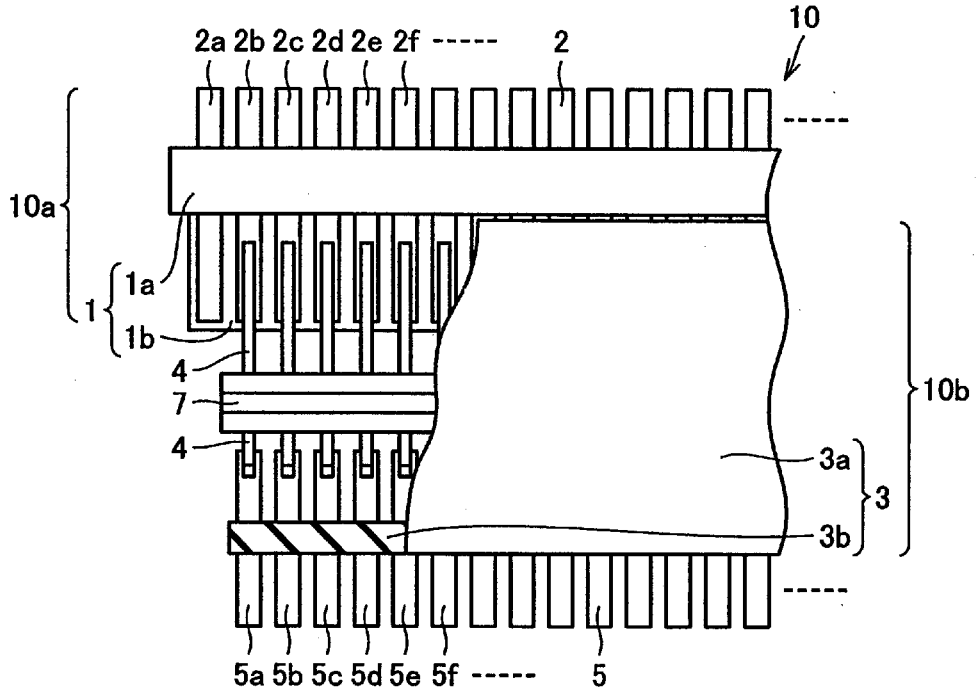
FIG. 6 is a partially fragmented front elevational view showing second connectional relation in the third embodiment of the present invention.
Figure 7:
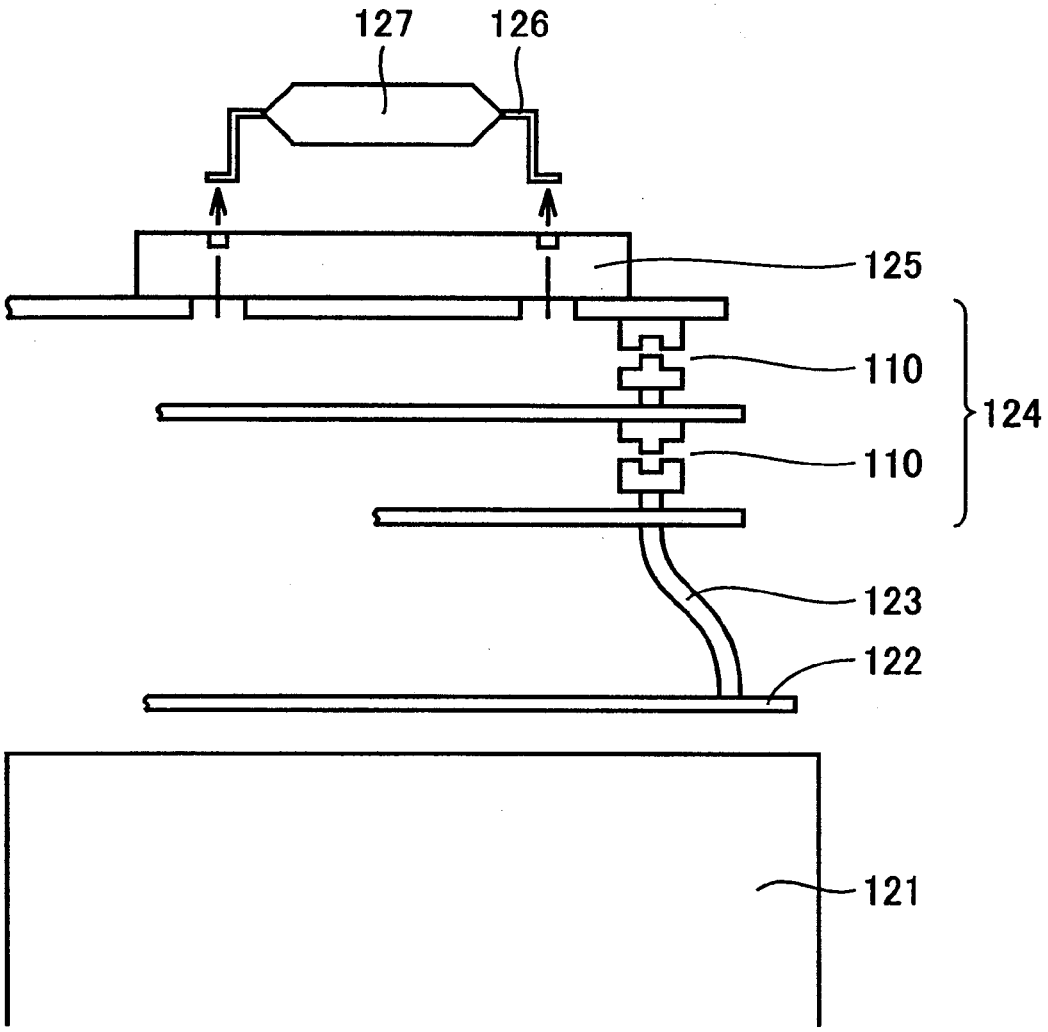
FIG.7 PRIOR ART
FIG. 7 illustrates a general tester for a semiconductor device.
Figure 8:
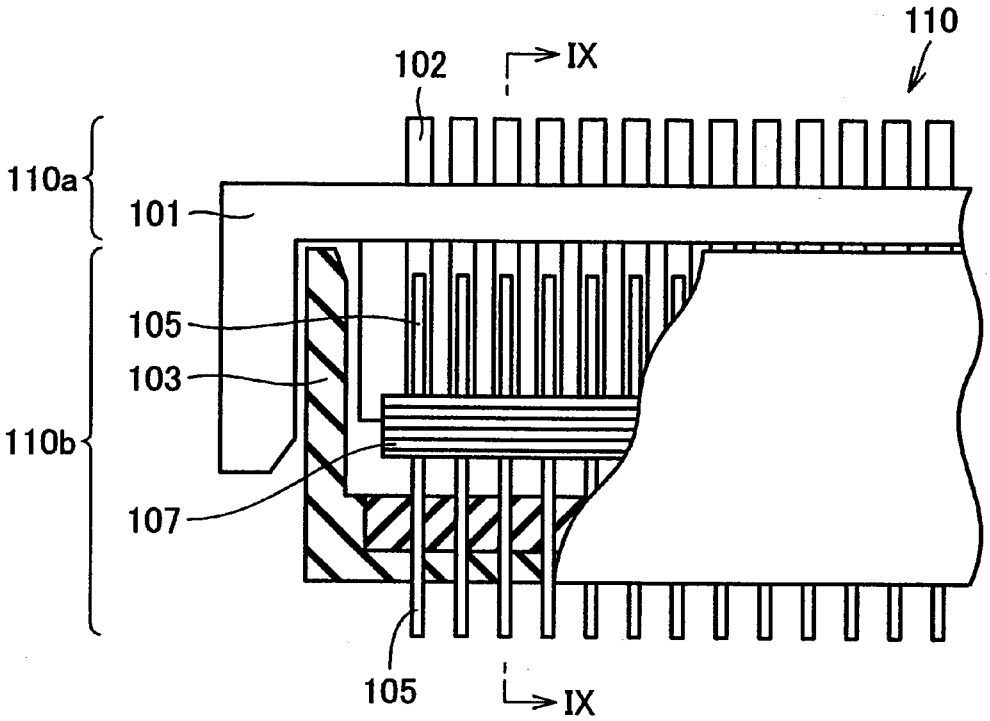
FIG.8 PRIOR ART
FIG. 8 is a partially fragmented front elevational view showing a conventional connector.
Figure 9:
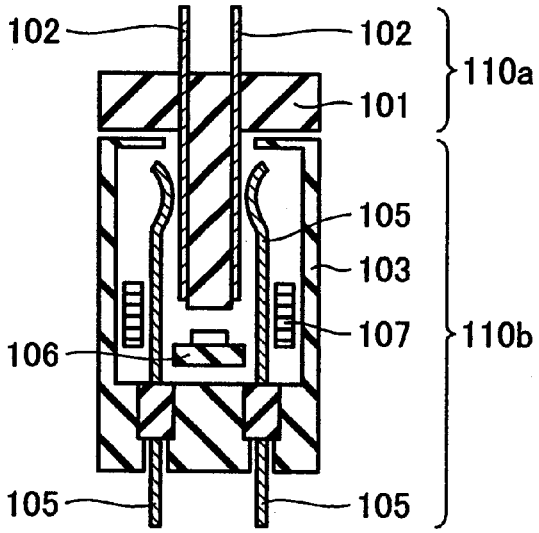
FIG.9 PRIOR ART
FIG. 9 is a sectional view taken along the line IX—IX in FIG. 8.

Referring to FIGS. 2 and 3, a male connector terminal 2*c* is not in electrical contact with a female connector terminal 5*a*. When the drive mechanism part 6 is on the position shown in FIG. 3, pairs of relay connector terminals 4 hold no male connector terminals 2 therebetween, and hence the male connector 10*a* can move along the direction of terminal arrangement with no hindrance. Therefore, the male connector 10*a* can be slid rightward without moving the female connector 10*b*, as shown in FIG. 2. Consequently, the male connector terminals 2 can be slid by only one pitch with respect to the female connectors 5 as shown in FIG. 6, for example, through a transitional state shown in FIG. 5. According to this rubbing along the direction of terminal arrangement, the male connector terminal 2 having been in electrical contact with the female connector terminal 5*a* is switched to come into electrical contact with a female connector terminal 5*b*.

A male connector terminal 2*b* having been in electrical contact with no female connector terminal is switched to come into electrical contact with the female connector terminal 5*a*.

After the aforementioned rubbing along the direction of terminal arrangement, the drive mechanism part 6 is moved downward for holding the male connector terminals 2 between the pairs of relay connector terminals 4 due to elastic restoring force while performing wiping on pairs of portions A and B. According to this wiping, the male and female connectors 2 and 5 can be stably electrically connected with each other after the aforementioned rubbing.

According to the aforementioned rubbing along the direction of terminal arrangement and the subsequent wiping, connection between signal lines connected to the male and female connector terminals 2 and 5 respectively can be simultaneously switched for performing connection and disconnection. The aforementioned movement along the direction of terminal arrangement of the male or female connector 10*a* or 10*b* can be performed with a peripheral drive mechanism using the connector 10.

According to this embodiment, a signal connected to each terminal of the male and female connectors 10*a* and 10*b* can be not only connected to and disconnected from a fixed terminal but also connected to another terminal through the aforementioned rubbing along the direction of terminal arrangement. Consequently, the connector 10 can switch connectional relation in addition to general functions of connection and disconnection for fixed connectional relation. In the rubbing along the direction of terminal arrangement, the distance between the male and female connectors 10*a* and 10*b* may not be changed and the male and female connectors 10*a* and 10*b* may not be separated from each other. However, the rubbing may alternatively be performed while changing the distance between the male and female connectors 10*a* and 10*b* or separating the male and female connectors 10*a* and 10*b* from each other, as a matter of course.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A connector comprising:

a male connector having a male connector body and a male connector terminal held by said male connector body;

a female connector having a female connector terminal electrically connected with said male connector terminal and a female connector body holding said female connector terminal;

a relay connector terminal movably mounted on either said male connector body or said female connector body; and a drive mechanism part bringing said relay connector terminal into contact with both of said male connector terminal and said female connector terminal and performing rubbing.

2. The connector according to claim 1, wherein said relay connector terminal is movably mounted on said female connector body, and said drive mechanism part inhibits said relay connector terminal from coming into contact with said male connector terminal in a first state and brings said male connector terminal and said relay connector terminal into contact with each other while moving said relay connector terminal to come into contact with said female connector terminal and rubbing said relay connector terminal with both of said male connector terminal and said female connector terminal when shifting from said first state to a second state.

3. The connector according to claim 2, wherein said relay connector terminal is formed by a pair of connector terminals consisting of two opposite connector fragments for holding said male connector terminal between said two connector terminal fragments.

4. The connector according to claim 2, wherein said male connector and said female connector have at least two connector terminals arranged along a common direction at a common pitch, said connector further comprising a rubbing mechanism for rubbing either said male connector or said female connector with respect to the counterpart along the direction of arrangement of said connector terminals when said drive mechanism part is in said first state.

5. The connector according to claim 2, wherein said drive mechanism part inhibits said male connector terminal and said relay connector terminal from coming into contact with each other against elastic force of at least either said male connector terminal or said relay connector terminal in said first state and elastically restores at least either said male connector terminal or said relay connector terminal for elastically pressing said male connector terminal and said relay connector terminal against each other and rubbing said male connector terminal and said relay connector terminal while elastically pressing said relay connector terminal and said female connector terminal against each other and rubbing said relay connector terminal and said female connector terminal when shifting from said first state to said second state.

6. The connector according to claim 5, wherein said relay connector terminal includes a drive mechanism engaging part engaging with said drive mechanism part when said drive mechanism part shifts from said first state to said second state and a projection stored in a guide defined by a cavity provided on a side wall of said female connector body.

7. A connector comprising:

a male connector having a male connector body and at least two male connector terminals held by said male connector body and arranged along a prescribed direction;

a female connector having at least two female connector terminals arranged along the same direction as said male connector terminals and a female connector body holding said at least two female connector terminals;

a switching mechanism part inhibiting said male connector terminals and said female connector terminals from coming into electrical contact with each other in a first state and individually bringing said female connector terminals and said male connector terminals into electrical contact with each other when shifting from said first state to a second state; and a connection switching mechanism part rubbing either said male connector or said female connector with respect to the counterpart along the direction of arrangement of said connector terminals when said switching mechanism part is in said first state.

8. The connector according to claim 7, wherein said male connector terminals and said female connector terminals are arranged at a common constant pitch, and said connection switching mechanism part includes a moving pitch control part rubbing either said male connector or said female connector with respect to the counterpart along the direction of arrangement of said connector terminals by integral times said prescribed pitch and stops said male connector or said female connector when said switching mechanism part is in said first state while bringing said male connector terminals and said female connector terminals into contact with each other on positions after said rubbing when said switching mechanism part shifts to said second state.

9. The connector according to claim 7, further including a relay connector terminal movably mounted on either said male connector body or said female connector body, wherein said switching mechanism part defines a clearance between said connector terminals held by said connector body not provided with said relay connector terminal and said relay connector terminal in said first state and brings said relay connector terminal into contact with both of said male connector terminals and said female connector terminals and performs rubbing when shifting from said first state to said second state.

10. The connector according to claim 9, wherein said switching mechanism part is mounted on said connector body provided with said relay connector terminal for inhibiting said male connector terminals and said relay connector terminal from coming into contact with each other against elastic force of at least either said male connector terminals or said relay connector terminal, and elastically restoring at least either said male connector terminals or said relay connector terminal for elastically pressing said male connector terminals and said relay connector terminal against each other while moving said relay connector terminal for elastically pressing said relay connector terminal against said female connector terminals and rubbing said relay connector terminal with both of said male connector terminals and said female connector terminals when shifting from said first state to said second state.

11. A connector comprising:

a first connector having a first connector body and a first connector terminal held by said first connector body;

a second connector having a second connector terminal electrically connected with said first connector terminal and a second connector body holding said second connector terminal;

a relay connector terminal movably located between the first and second connector terminals, and a drive mechanism part configured to bring said relay connector terminal into contact with both of said first and second connector terminals and to rub the relay terminal against said first and second connector terminals.

12. A connector comprising:

a relay terminal configured to be located between first and second connector terminals to be connected through the relay terminal; and a drive mechanism part configured to bring said relay connector terminal into contact with both of said first and second terminals and to rub the relay terminal against said first and second connector terminals.

* * * * *